United States Patent [19]

Buchmann

[11] 4,232,484

[45] Nov. 11, 1980

[54] APPARATUS FOR MOVING TOLL BARS OR THE LIKE

[75] Inventor: Hans Buchmann, Oetwil, Switzerland

[73] Assignee: Zuhlke Engineering AG, Schlieren, Switzerland

[21] Appl. No.: 971,356

[22] Filed: Dec. 20, 1978

[30] Foreign Application Priority Data

Dec. 21, 1977 [CH] Switzerland ..... 015788/77

[51] Int. Cl.[3] ..... E05F 15/02; E05F 15/10; E01F 23/00

[52] U.S. Cl. ..... 49/334; 49/13; 49/28; 49/49

[58] Field of Search ..... 49/334, 49, 35, 28, 49/13, 14

[56] References Cited

U.S. PATENT DOCUMENTS

| | | | |
|---|---|---|---|
| 438,620 | 10/1890 | Gillette | 49/334 X |
| 1,886,435 | 11/1932 | Vincent | 49/334 X |
| 1,893,824 | 1/1933 | McWhirter | 49/28 |
| 1,899,496 | 2/1933 | Day | 49/334 |
| 1,997,199 | 4/1935 | Pranger | 49/334 X |
| 2,295,419 | 9/1942 | Miskelly | 49/13 X |
| 2,599,744 | 6/1952 | Brundage | 49/334 |
| 3,686,794 | 8/1972 | Sakamoto et al. | 49/49 X |
| 3,857,197 | 12/1974 | Reddy et al. | 49/13 |
| 3,955,661 | 5/1976 | Popper et al. | 49/28 X |

*Primary Examiner*—Philip C. Kannan
*Attorney, Agent, or Firm*—Peter K. Kontler

[57] ABSTRACT

The toll bar of a tollgate is pivotable between horizontal and vertical positions by a reversible electric motor through the medium of a swingable crank gear. A frame for the motor and crank gear is turnable on the shaft for the toll bar and causes a switch to open the motor circuit when the bar encounters excessive resistance to movement toward its horizontal position. The bar is detachably coupled to a holder and causes a switch to actuate an alarm device when it is detached from the holder in response to engagement by a vehicle which passes the tollgate while the bar is away from the vertical position.

11 Claims, 6 Drawing Figures

APPARATUS FOR MOVING TOLL BARS OR THE LIKE

BACKGROUND OF THE INVENTION

The present invention relates to apparatus for moving toll bars or barriers between blocking and retracted positions, especially for moving toll bars between horizontal and vertical end positions. Such bars are utilized at toll gates, for example, on parkways or other toll roads, at the entrances to or exits from parking areas, at entrances to parkways or expressways and for analogous purposes. More particularly, the invention relates to improvements in apparatus for moving toll bars or analogous barriers between their end positions by resorting to a prime mover.

Presently known apparatus for moving toll bars normally comprise a motor which transmits motion to the toll bar by way of a combined worm and crank drive which is self-locking in each and every angular position of the bar. The self-locking action is furnished by the worm drive. Such self-locking action is desirable in one or both end positions of the bar, i.e., when the bar extends horizontally across a lane in which vehicles are driven, for instance, into or from a parking area and preferably also when the bar is held in vertical or nearly vertical position to allow the vehicles to pass. Self-locking action in vertical position of the bar is desirable when the apparatus is idle to prevent accidental descent to the horizontal position. Self-locking action in the horizontal position of the bar is desirable to prevent unauthorized lifting of the bar, e.g., by a driver who wishes to drive his or her vehicle into or from a parking area without paying the prescribed amount of money. On the other hand, self-locking action in an intermediate position of the bar is not desirable, especially if the toll booth is unattended which is customary at toll gates that can be passed by drivers having the exact change. For example, if the bar accidentally engages the trunk, roof or hood of a slowly moving vehicle, the driver of the vehicle, another occupant or an attendant should be in a position to lift the bar with a minimum of effort. In many presently known apparatus, the motor which is coupled to the input element of transmission for the bar is automatically disconnected when the bar encounters an obstruction during movement to the one or the other end position. A conventional apparatus then locks the bar in the intermediate position and the driver is unable to immediately lift the bar without the exertion of a substantial effort and/or without damaging certain parts of the apparatus.

OBJECTS AND SUMMARY OF THE INVENTION

An object of the invention is to provide an apparatus wherein the means for moving the toll bar between its end positions is constructed and assembled in such a way that it is self-locking only in the two end positions of the bar so that the latter can be readily moved to an end position by hand when the moving means is arrested before the bar reaches the one or the other end position.

Another object of the invention is to provide a simple and compact apparatus wherein the toll bar cannot be damaged or is unlikely to be damaged if it is struck by a vehicle which attempts to pass the tollgate before the bar is moved to its retracted position.

A further object of the invention is to provide an apparatus which can furnish readily detectable signals when the toll bar is detached to thus warn an attendant that the bar must be reattached to the moving means.

An additional object of the invention is to provide the apparatus with means for moving the toll bar at different speeds, preferably at a lower speed from its operative position and at a higher speed back to operative position.

A further object of the invention is to provide an apparatus wherein the means for moving the toll bar is automatically arrested when the latter encounters a predetermined resistance to movement to the one or the other end position.

An ancillary object of the invention is to provide novel and improved means for transmitting motion from a prime mover to the toll bar.

One feature of the invention resides in the provision of an apparatus which is installed in or at a tollgate or the like and comprises a support (such support may include an upright column and a housing on top of the column), a bar which is mounted on the support and is movable between first and second end positions (preferably between a horizontal position in which it extends across a lane wherein the vehicles move through the tollgate and a vertical position in which the bar is out of the way), and means for moving the bar between the two end positions. Such moving means includes a prime mover (preferably a reversible electric motor) and a swinging or oscillating crank guide transmission having an input element (e.g., a pinion) which is connected with and receives motion from the prime mover and an output element (e.g., a horizontal shaft and a holder secured to the shaft and detachably supporting one end portion of the bar) which is connected with the bar. The crank guide transmission is self-locking only in the two end positions of the bar so that the bar can be readily pivoted from an intermediate position to at least one end position when the prime mover is arrested while the bar is remote from both end positions.

In accordance with another feature of the invention, detachment of the bar from its holder results in tripping of an alarm device which generates a readily detectable (visual and/or audible) signal to inform the attendant that the bar must be reattached to the holder. For example, the bar can be detached from the holder by the hood of a vehicle which attempts to pass the tollgate while the bar is held in the horizontal position or is sufficiently remote from the vertical position to interfere with forward movement of the vehicle.

In accordance with an additional feature of the invention, the prime mover and the transmission are mounted in a frame which is pivotable about the aforementioned shaft. If the bar encounters excessive resistant to movement toward its horizontal position (e.g., because it abuts against a portion of a vehicle therebelow), the frame is pivoted from a predetermined position and opens a switch in the circuit of the prime mover to prevent further forcible movement of the bar to its horizontal position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
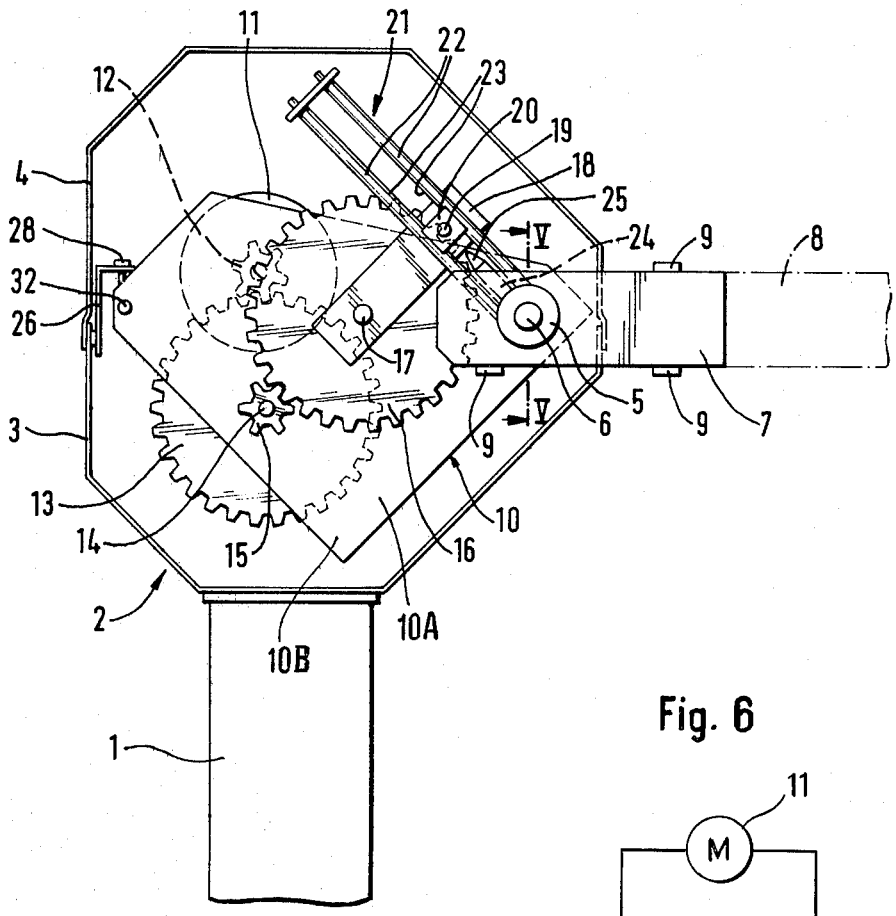
FIG. 1 is a fragmentary schematic side elevational view of an apparatus which embodies the invention, the front part of the housing being broken away and the toll bar being shown in the horizontal or blocking position.

Referring to FIG. 1, the improved apparatus comprises an upright column 1 whose lower end portion is secured to the ground, e.g., adjacent to one side of a lane in which automotive vehicles advance, for instance, in order to enter or leave a parking area. The upper end portion of the column 1 carries a housing 2 which includes a lower portion 3 secured to the column 1 and an upper portion or hood 4 which is separately secured to and overlies the lower portion 3. The column 1 and the housing 2 constitute a composite support for all other component parts of the apparatus. The housing 2 supports two coaxial bearings 5 (only one shown in each of FIGS. 1 to 3) for a horizontal shaft 6 which is turnable back and forth in order to move a toll bar or barrier 8 between a substantially horizontal or blocking position (first end position shown in FIG. 1) and a substantially vertical or retracted position (second end position shown in FIG. 3). The shaft 6 is rigidly connected with a holder 7 for the adjacent end portion of the bar 8. The separable coupling between the bar 8 and the holder 7 includes several (e.g., three) elastic detents in the form of springs 9 which extend into complementary sockets 40 (see FIG. 5) of that end portion of the bar 8 which is received in the holder 7. Thus, the bar 8 can be detached by the simple expedient of expelling the springs 9 from the respective sockets 40, e.g., by exerting on the bar a pull in a direction away from the holder 7 or by pushing the bar in a direction which is parallel to the shaft 6.

Figure 2:
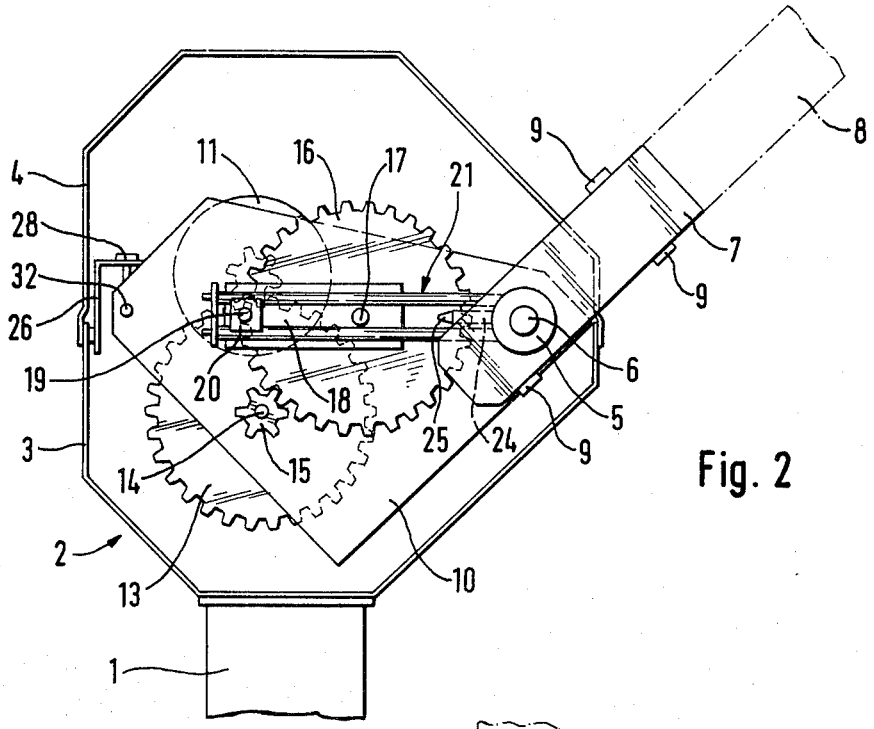
FIG. 2 shows the structure of FIG. 1, with the bar in an intermediate position.
Figure 3:
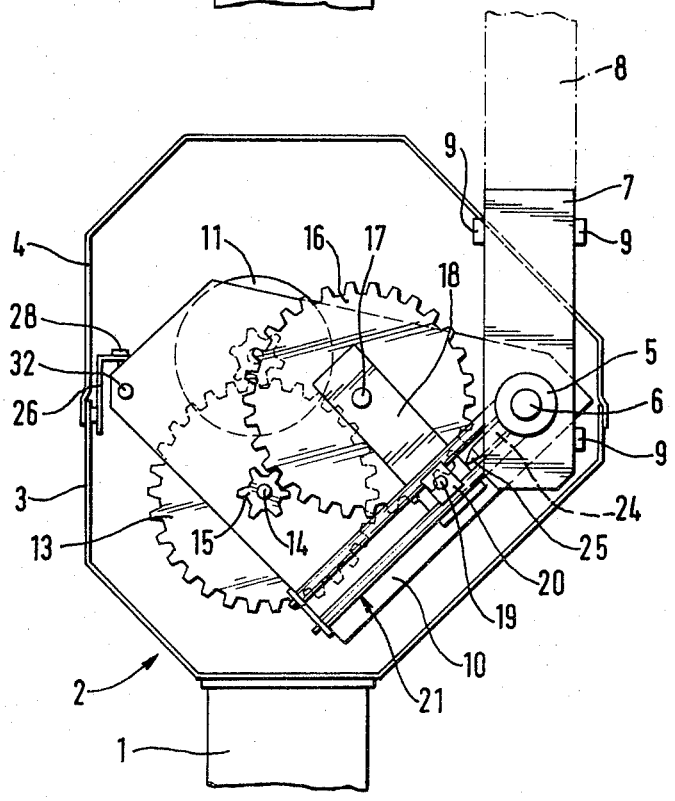
FIG. 3 shows the structure of FIG. 1 with the bar in the retracted or vertical position.

The shaft 6 further supports a swingable frame 10 which comprises two spaced-apart parallel vertical plates 10A and 10B connected to each other by one or more crossheads 32 (one shown). Means (to be described in connection with FIG. 4) is provided for normally holding the frame 10 in the operative or predetermined position which is shown in FIGS. 1 to 3. A reversible electric motor 11 or another suitable prime mover is mounted between the plates 10A and 10B of the frame 10. The output shaft of the motor 11 is parallel to the shaft 6 and drives a first gear 12 meshing with a larger second gear 13 fixedly mounted on a shaft 14 which is rotatably journalled in the frame 10. The shaft 14 drives a relatively small third gear 15 which meshes with a larger fourth gear 16 rotatably mounted on a shaft 17 which is installed in and cannot rotate relative to the frame 10. The gear 16 is fixedly connected to and transmits motion to a crank arm 18 provided with a crank pin or wiper 19 which extends into the slot of an elongated slide-like follower or crank guide 21. The guide 21 comprises two parallel elongated rods 22 of circular cross-sectional outline, and the crank pin 19 rotatably supports a block 20 having two recesses bounded by concave surfaces which receive portions of the respective rods 22. The crank pin 19 is remote from the shaft 17. The block 20 can be said to constitute a portion of the crank pin 19; for example, the pin 19 can be integral with the block 20 and a portion thereof can be rotatably mounted in the outer end portion of the crank arm 18. When the gear 16 turns the crank arm 18 about the shaft 17, the concave surfaces of the block 20 slide along complementary tracks 23 which are defined by the respective rods 22.

The shaft 6 supports a stop 24 which extends into the space between the rods 22, i.e., into the path of movement of the block 20 along the tracks 23. That end portion of the stop 24 which is remote from the shaft 6 carries an elastic cushion, e.g., a pad 25 made of rubber or another elastomeric material which can be struck by the block 20 in the two end positions of the bar 8. Instead of or in addition to being located in the path of movement of the block 20, the pad 25 can be positioned in such a way that it is engaged by and arrests the crank arm 18.

FIG. 1 shows that the crank arm 18 and/or the block 20 abuts against the pad 25 in the first end position (i.e., in the horizontal position) of the bar 8. Thus, the pad 25 prevents further clockwise rotation of the bar 8 about the axis of the shaft 6, i.e., the bar 8 is invariably held against clockwise movement beyond the three o'clock position.

If the crank arm 18 is thereupon turned in a counterclockwise direction, as viewed in FIG. 1 (e.g., in response to completion of motor circuit by a switch 111 (FIG. 6) which is actuated by depositing one or more coins or tokens in a basket at the tollgate), i.e., if the direction of rotation of the motor 11 is selected in such a way that the block 20 begins to move away from the pad 25, the block 20 turns the guide 21 about the axis of the shaft 6 so that the guide moves toward and beyond the position of FIG. 2 and thereby raises the bar 8 toward and to the retracted (substantially vertical) position of FIG. 3. When the crank arm 18 is turned through 270 degrees (compare FIGS. 1 and 3), it and/or the block 20 again engages the elastically deformable pad 25 which thereby arrests the bar 8 in the raised or retracted position. Consequently, for instance a vehicle can be driven through the tollgate, either into or from the parking area. When the direction of operation of the motor 11 is reversed again, the crank arm 18 rotates in a clockwise direction, as viewed in FIG. 3, and returns the bar 8 to the horizontal position of FIG. 1 when the gear 16 completes an angular movement through 270 degrees. The pad 25 is again engaged by and stops the crank arm 18 and/or the block 20. The circuit of the motor 11 comprises suitable limit switches (not specifically shown) which automatically open the circuit when the arm 18 and/or the block 20 engages the pad 25, i.e., when the bar reaches the position of FIG. 1 or FIG. 3. The aforementioned switch 111 which is actuated in response to deposition of one or more coins or tokens is connected in parallel with the limit switch which opens the motor circuit as soon as the bar 8 returns to the position of FIG. 1 so that the bar is lifted again in response to deposition of another coin or token. As is customary, the bar 8 is automatically retured to the position of FIG. 1 after a vehicle has passed therebelow, and the bar thereupon remains in the position of FIG. 1 until and unless a coin or token (or a requisite number of coins or tokens) is inserted into the receptacle or slot at the tollgate so as to complete the circuit of the motor 11 in a direction to lift the bar 8.

The pad 25 constitutes a simple and reliable means for accurately locating the bar 8 in the two end positions, provided that the speed at which the bar 8 moves to one end position matches the speed of movement to the other end position.

If the stop 24 is omitted together with the pad 25, and the crank arm 18 is always rotated in the same direction, closing of the bar 8 is effected at three times the speed of movement of the bar to its retracted or raised position. This will be readily appreciated by looking at FIG. 3 and assuming that the parts 24 and 25 are omitted. The bar 8 is returned to the horizontal position in FIG. 1 in response to counterclockwise rotation of the crank arm 18 through 90 (rather than 270) degrees. Such construction may be desirable to prevent a second vehicle (immediately behind the vehicle whose occupant has paid the required amount for opening the bar) from entering or leaving the parking area without paying the required amount. Of course, the speed at which the bar 8 returns to horizontal position (in the absence of parts 24 and 25) is higher only if the speed of angular movement of the crank arm 18 is constant.

In the illustrated embodiment, the relationship of the radius R of the circular path of the crank pin 19 about the axis of the shaft 17 to the distance A between the axes of the shafts 6 and 17 can be expressed as follows: $2R\sqrt{3} \leqq A \leqq 2R$.

FIG. 2 shows the bar 8 in an intermediate position in which the block 20 is located in the left-hand end of the slot between the rods 22 of the guide 21. The block 20 assumes such a position after the gear 16 has completed an angular movement through 135 degrees, as viewed in FIG. 1. The axes of the crank pin 19, shaft 17 and shaft 6 are then located in a common horizontal plane. As the gear 16 continues to turn the crank arm 18 in a counterclockwise direction, the block 20 moves back toward the stop 24 and is arrested by the pad 25 when the gear 16 completes a further angular movement through 135 degrees (see FIG. 3). Thus, the block 20 moves away from the pad 25 during one half and toward the pad 25 during the other half of angular movement of the crank arm 18 from the position of FIG. 1 toward the position of FIG. 3. The parts 6–7 and 12–23 together constitute a swingable or oscillatable crank guide drive or transmission for the bar 8 which moves the bar between the end positions of FIGS. 1 and 3 in response to back-and-forth angular movements of the crank arm 18 (in the presence of stop 24 and pad 25) or in response to unidirectional angular movement of the crank arm 18 through 360 degrees. The pinion 12 can be said to constitute the input element of the crank guide transmission, and the parts 6, 7 can be said to constitute the output element of the crank gear.

Figure 4:
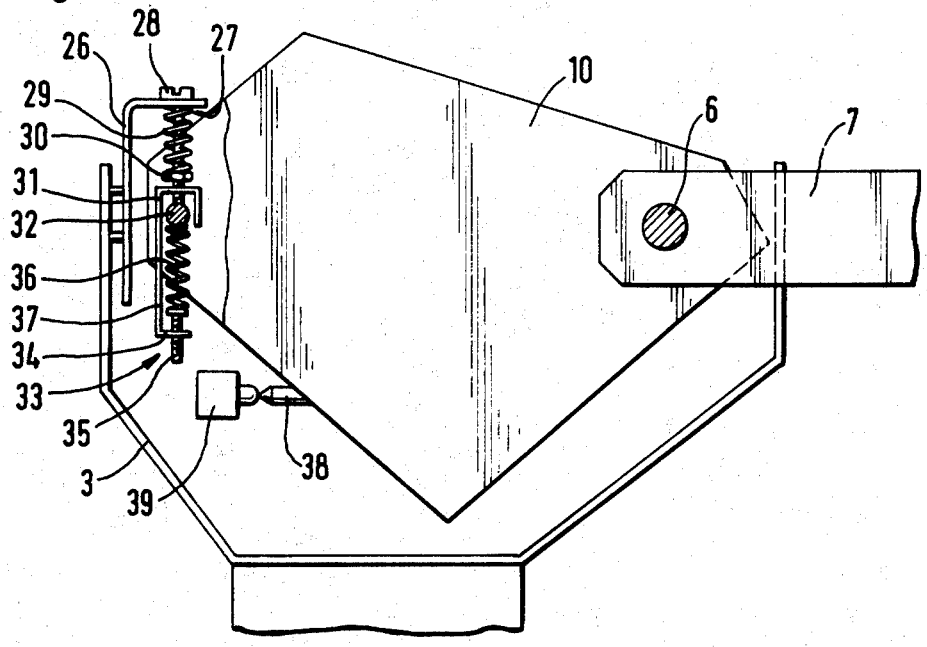
FIG. 4 illustrates the construction of means for automatically arresting the motor when the bar encounters a certain resistance to movement to the position of FIG. 1.

The improved apparatus further comprises means for automatically arresting the motor 11 when the bar 8 encounters a predetermined resistance to movement to one end position, particularly to the horizontal position of FIG. 1 (e.g., because the bar 8 abuts against the hood, roof or trunk of a slowly moving vehicle). Such arresting means constitutes a safety device the details of which are shown in FIG. 4. This safety device comprises a bracket or an analogous support 26 (also shown in FIGS. 1–3) which is fixedly mounted on the lower portion 3 of the housing 2. The horizontal leg of the bracket 26 has a bore or hole 27 for a vertically movable screw 28 which constitutes an arresting member. The shank of the screw 28 is freely reciprocable in the hole 27 and is surrounded by a helical spring 29 which tends to expand and whose bias can be adjusted by a nut 30 meshing with the screw 28. The lower end portion of the shank of the screw 28 normally abuts against a second arresting member 32 which is secured to the frame 10. The illustrated arresting member 32 can constitue one of the aforementioned crossheads which connect the plates 10A and 10B of the frame 10 to each other. The lower end portion of the screw 28 further carries a bracket 31. The spring 29 reacts against the horizontal leg of the bracket 26 and bears against the nut 30 to urge the screw 28 downwardly so that the head of the screw normally abuts against the horizontal leg of the bracket 26.

A connector 37 secures the bracket 31 on the screw 28 to a supporting unit 33 which is located at the underside of the arresting member 32, i.e., opposite the screw 28. The unit 33 comprises a carrier 34 which has a tapped bore for a screw 35. The head of the screw 35 is located at the lower end of a prestressed helical spring 36. The spring 36 reacts against the head of the screw 35 and biases the arresting member 32 upwardly to thereby urge the frame 10 in a clockwise direction, as viewed in FIG. 4. On the other hand, the spring 29 biases the screw 28 and the bracket 31 downwardly, i.e., the screw 28 normally abuts against the upper side of the arresting member 32. The bias of the springs 29 and 36 is adjusted in such a way that the frame 10 is moved from its predetermined position (by turning about the axis of the shaft 6) when the bar 8 encounters a predetermined resistance to movement toward the end position of FIG. 1.

Figure 6:
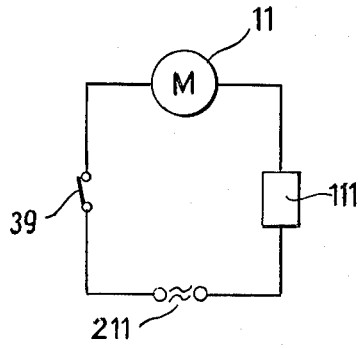
FIG. 6 shows the circuit of the prime mover.

The frame 10 carries an actuating element or trip 38 for a switch 39 which is connected in circuit with the motor 11 (see FIG. 6). When the frame 10 is pivoted counterclockwise from the position of FIG. 4, the trip 38 releases the switch 39 and the latter opens the circuit of the motor 11. Referring to FIG. 4, the frame 10 is pivoted in a counterclockwise direction when the descending bar 8 engages a portion of an automotive vehicle therebelow. The spring 36 is compressed and the trip 38 moves out of register with the depressible contact of the switch 39 so that the motor 11 comes to a halt. Since the crank guide transmission 7–8, 12–22 is self-locking only in the two end positions of the bar 8, the bar 8 can be readily lifted by hand to allow the vehicle to pass. The spring 36 thereupon returns the frame 10 to the position which is shown in the drawing, i.e., the switch 39 is closed again so that it completes the corresponding portion of the circuit of the motor 11 when the arresting member 32 abuts against the lower end of the screw 28.

The screw 28 is adjustable substantially tangentially of the path of movement of the arresting member or crosshead 32 about the axis of the shaft 6.

Figure 5:
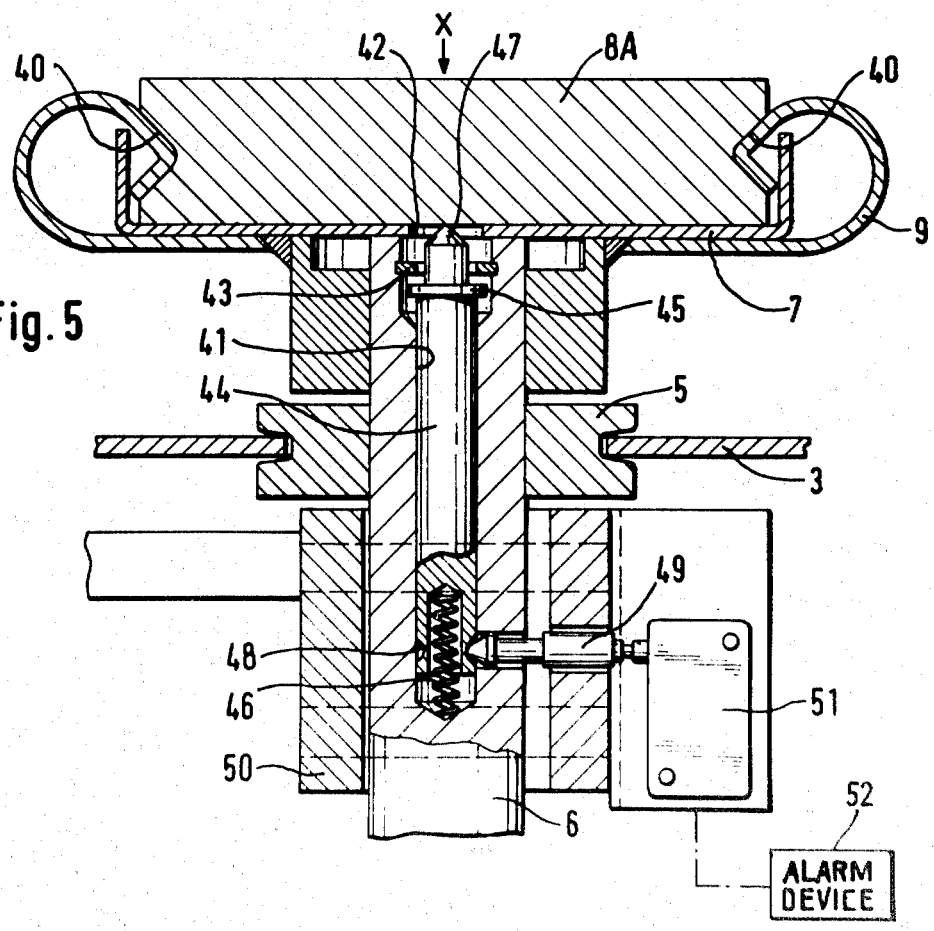
FIG. 5 is an enlarged sectional view as seen in the direction of arrows from the line V—V of FIG. 1, showing the means for actuating an alarm device when the bar is knocked out of its holder.

As mentioned above, the bar 8 can be readily detached from the holder 7. This is particularly desirable if a vehicle which moves in a direction of substantial parallelism with the axis of the shaft 6 strikes against the front side 8A of the bar 8. FIG. 5 shows that the front side of the holder 7 is open (i.e., the holder is a substanially U-shaped body which surrounds the respective end portion of the bar 8 at three sides) so that a force acting in the direction indicated by arrow X causes expulsion of the wedge like portions of springs 9 from the sockets 40 of the bar 8 and the latter is simply pushed aside. The sockets 40 are machined into the narrow sides of the bar 8, i.e., into the upper side and the underside, as viewed in FIG. 1.

In order to insure that the uncoupling of the bar 8 from the holder 7 can be detected without delay, i.e., that an attendant can immediately reattach the bar to the holder, the apparatus further comprises means for generating a suitable signal (e.g., an electric signal) which trips an alarm device 52 (shown schematically in FIG. 5). The signal generating means is illustrated in FIG. 5 and comprises a post or plunger 44 which is reciprocable in a blind axial bore 41 of the shaft 6. The bore 41 registers with a bore or hole 42 of the holder 7. That portion of the bore 41 which is adjacent to the holder 7 is enlarged and contains a split ring 43 or another suitable retainer for a collar 45 on the plunger 44. Thus, the split ring 43 limits the extent of movement of the plunger 44 toward and through the hole 42 of the holder 7. The innermost portion of the bore 44 contains a helical spring 46 which biases the conical tip 47 of the plunger 44 against the rear side of the bar 8 when the latter is properly coupled to the holder 7. The spring 46 extends into a blind bore in the inner end portion of the plunger 44. The latter is further provided with a circumferential groove 48 (this groove can be replaced by a shallow hole or bore if the plunger 44 cannot rotate in the shaft 6) for the tip of a reciprocable trip 49 which can actuate a normally open switch 51 in circuit with the alarm device 52. The switch 51 is mounted on a bearing member 50 which, in turn, is mounted on the shaft 6.

When the bar 8 is detached from the holder 7, the spring 46 expands and propels the plunger 44 upwardly, as viewed in FIG. 5, so that the collar 45 moves toward and is arrested by the split ring 43 at a time when the tip 47 extends into the holder 7. Such axial movement of the plunger 44 results in expulsion of the trip 49 from the groove 48 whereby the trip 49 causes or allows the switch 51 to actuate the alarm device 52. The attendant thereupon attaches the bar 8 to the holder 7 whereby the bar depresses the plunger 44 so that the trip 49 reenters the groove 48 and the switch 51 opens to deactivate the alarm device 52. It will be noted that the alarm device 52 is idle when the collar 45 is remote from the split ring 43, i.e., when the bar 8 is properly coupled to the holder 7.

FIG. 6 shows the circuit of the motor 11. This circuit comprises the switch 39 in series with a source 211 of electrical energy and with the aforementioned switch 111 which can open or close the circuit as well as reverse the direction of rotation of the motor 11.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. In a tollgate or the like, the combination of a support; a bar mounted on said support and movable between a first and second end position; and means for moving said bar between said end positions, including a prime mover and a swinging crank guide transmission having an input element connected with said prime mover and an output element connected with said bar, one of said elements including a pivotable crank guide and the other including an orbiting crank portion guided by said crank guide.

2. The combination of claim 1, wherein said output element comprises a rotary shaft and said crank guide is connected with said shaft.

3. The combination of claim 1, wherein said crank guide comprises two spaced-apart parallel rods and wherein said crank portion is disposed between and slidable with respect to said rods.

4. The combination of claim 1, said other element further comprising means defining an orbiting axis for orbital movement of said crank portion and said one element further comprising means defining a pivot axis for pivotal movement of said crank guide, the ratio of the distance between said orbiting axis and said crank portion to the distance between said orbiting axis and said pivoting axis being $$2R\sqrt{3} \leqq A \leqq 2R$$

wherein R is said first mentioned distance and A is said last mentioned distance.

5. The combination of claim 1, wherein said prime mover comprises a reversible electric motor and further comprising direction reversing means in circuit with said motor.

6. The combination of claim 1, further comprising stop means secured to said crank guide and abutting against said crank portion in said end positions of said bar.

7. In a tollgate or the like, the combination of a support including a housing; a bar mounted on said housing and movable between spaced-apart end positions; means for moving said bar between said end positions including a motor in said housing, a shaft rotatably mounted in said housing and drivingly connected to said bar and a transmission interposed between said motor and said shaft, a frame for said motor and said transmission, said frame being turnable on said shaft, and means for arresting said motor in response to pivoting of said frame with respect to said shaft as a result of resistance of said bar to movement between said end positions.

8. The combination of claim 7, further comprising means for yieldably biasing said frame to a predetermined position in which said arresting means is idle.

9. The combination of claim 8, wherein said biasing means comprises a first arresting member on said frame, a second arresting member mounted in said housing for movement substantially tangentially of the path of movement of said first member about said shaft, first resilient means for urging said second member against one side of said first member, and second resilient means for urging said first member against said second member.

10. In a tollgate or the like, the combination of a support; a holder mounted on said support and movable between first and second end positions; a bar; and means for detachably coupling said bar to said holder so that the bar in its entirety is separable from said holder in response to the application of a stress of predetermined magnitude in a given direction.

11. The combination of claim 10, further comprising means for generating a detectable signal in response to detachment of said bar from said holder.

* * * * *